US006607021B1

(12) United States Patent
Rahmfeld

(10) Patent No.: US 6,607,021 B1
(45) Date of Patent: Aug. 19, 2003

(54) RADIUS CONFIGURATION OF A STRAND GUIDE OF A VERTICAL BENDING CASTER

(75) Inventor: Werner Rahmfeld, Mülheim a..d. Ruhr (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/718,146

(22) Filed: Nov. 21, 2000

(30) Foreign Application Priority Data

Nov. 24, 1999 (DE) ..... 199 56 556

(51) Int. Cl.[7] ..... B22D 11/08
(52) U.S. Cl. ..... 164/441; 164/418
(58) Field of Search ..... 164/418, 459, 164/441

(56) References Cited

U.S. PATENT DOCUMENTS 4,043,382 A * 8/1977 Saito et al. ..... 164/76
4,424,855 A * 1/1984 Tsubakihara et al. ..... 164/485
4,476,915 A * 10/1984 Rahmfeld et al. ..... 164/484
4,953,614 A * 9/1990 Lemper ..... 164/416
6,129,137 A * 10/2000 Pleschiutschnigg ..... 164/476
6,155,332 A * 12/2000 Hodl et al. ..... 164/459
6,276,436 B1 * 8/2001 Pleschiutschnigg ..... 164/476

FOREIGN PATENT DOCUMENTS

AT 0373518 1/1984
GB 2 329 141 A * 3/1999

* cited by examiner

*Primary Examiner*—Tom Dunn
*Assistant Examiner*—Len Tran
(74) *Attorney, Agent, or Firm*—Sidley Austin Brown & Wood, LLP

(57) ABSTRACT

A radius configuration of a strand guide of a vertical bending caster and including following over another bending zone, transition straightening zone, main radius guide zone, and transition final straightening zone, with the bending zone having at least one first region with a comparatively stronger bend and defined by a curvature formed by a series of continuously smaller, starting from an infinite radius of the vertical section of the strand guide, radii, and a second region adjoining the first region and having a comparatively smoother bend in comparison with that of the first region, and with the transition straightening zone, guide zone, being defined by a curvature with continuously increasing lengths of curvature-forming radii.

10 Claims, 1 Drawing Sheet

RADIUS CONFIGURATION OF A STRAND GUIDE OF A VERTICAL BENDING CASTER

BACKGROUND OF THE INVENTION

1. Field of the Invention

The present invention relates to a radius configuration of a strand guide of a vertical bending caster converted from a circular arc caster and having a straight mold, a vertical section arranged upstream of a vertically oriented bending section, and a horizontal section arranged downstream of the vertically oriented bending section, with the radius configuration including a bending zone, a transition straightening zone, a main radius guide zone, and a transition, final straightening zone.

2. Description of the Prior Act

Upon modernization of existing continuous casting machines or casters, it is advantageous to convert a circular arc caster to a vertical bending caster. Such conversion noticeably improves the percentage purity of a cast strand, e.g., a steel strand.

Circular arc continuous casting machines or casters with a curved mold arc known since long ago and are used throughout the world. However, with an increased tendency to develop thin slab continuously casting machines, with the thin slab thickness varying between 20 and 150 mm and with the slab width amounting up to 3,500 mm, there exists a noticeably increased danger that together with the molten metal stream, impurities such as slag and gas bubbles could be brought into the liquid core of the strand and would not raise to the meniscus. Further, with economically beneficial improvement of methods of continuous casting with the use of high pouring rates, there exists a danger of an increased impurity of the cast products.

Moreover, in a curved mold, the stream characteristics of a melt are less uniform and, as a result, are less favorable than in a straight mold. As a result, with a curved mold and, in particular, during casting of thin slabs, disturbances in the shell growth take place. For the foregoing reasons, later, a tendency developed to convert continuous casting machines with a curved mold to continuous casting machines with a straight mold. One of the possibilities to keep the conversion costs within acceptable limits, consists in using, to a most possible extent, the original strand guide of the circular arc machine in the bending region of the new vertical bending machine or caster. The existing parts and constructive elements of the original strand guide should be integrated into the bending region of the new vertical bending machine or caster.

Further, the conversion should be so effected that the use of elements of a conventional circular arc caster does not alter the dimensions and does not affect operation of the straightening unit of the continuous casting machines or caster.

In order to provide for improvement of the metallurgical conditions, in particular the metal conveying, an original curved mold should be replaced by a straight mold that could be arranged downstream of a sufficiently long vertical section for ascending of oxidic or gaseous inclusions. In order to be able to integrate into the conversion concept the vertical section which is arranged upstream of the vertically oriented bending section, and the horizontal section arranged downstream of the bending section, without any substantial changes in the height and length of the continuous casting machine, a new concept of the radius configuration of the strand guide was required according to which the strand guide having a straight vertical shape should have been converted into a strand guide having a special arcuate shape and a horizontal end element.

Continuous casting machines or casters in which a strand, which still has a liquid core, is deflected, during solidification, from a vertical casting direction to a horizontal direction and is straighten, are known.

German Patent No. 1,433,022 discloses a method of and an apparatus for continuous casting of metals according to which a strand with a liquid core is deflected into the horizontal direction and is straighten, with the straightening being effected stepwise. In the apparatus for effecting the method, the rollers, which are used for effecting the stepwise straightening, are actuated. At that, the large stresses, which develop during straightening with a liquid core, are reduced in the solidified shell, and the height of the machine is reduced.

European Publication EP 0 934 786 A1 discloses a method of continuous casting of metal and a casting machine for effecting the method and having a vertical mold with a subsequent stripping of the strand formed in the mold. Then, the strand is bent, in a bending zone along a transition course, in a circular shape with a radius Rend, is guided along a circular arc guide with the radius Rend and, finally, is directed into an end straightening zone along a transition curve and then is extracted through a substantially horizontal straight guide.

In order to convert a continuous casting machine with a curved mold into a continuous casting machine with a straight mold, according to EP 0 934 786 A1:

A straight strand, which leaves the straight mold, is bent in at least one bending zone along a transition curve into a circular arc shape having a first small radius Rmin. Then, the strand is bent in an arranged downstream, straightening zone along a transition curve into a circular arc shape having a larger, than first radius Rmin, second radius Rend. Preferably, the second radius Rend corresponds to the radius of the strand circular arc shape obtained in the original continuous casting machine with a curved mold.

Austrian Patent No. 373,518 discloses a strand guide for a continuous casting machine. The strand guide should be so formed that the rollers of a strand guide section, which adjoins a transition curve, are stressed less than before due to strand rebound, and that the stripping forces are reduced. In the strand guide of the Austrian Patent, the curvature of the transition curve in its end region is greater than the curvature of the transition curve of the following strand guide section. The curvature of the transition curve in its end region is preferably larger than the curvature of the transition curve of the following strand guide section by a value of the elastic component of the deformation. As a result, the strand, upon leaving the strand guide section with the transition curve, has the same curvature as the following strand guide section at its beginning.

The object of the present invention is to provide a radius configuration of a strand guide of a vertical bending caster converted from a circular arc caster and having a straight mold, a vertical section arranged upstream of a vertically oriented bending section, and a horizontal section arranged downstream of the bending section, with the maximum possible use of parts and elements and/or modules of the convertible strand guide with a curved mold.

Another object of the present invention is to provide a radius configuration of a strand guide of a continuous casting machine with a straight mold of the type described above, with the substantially unchanged height and orientation of the continuous casting machine or caster with respect to the tundish, and with an unchanged casting hall.

A further object of the present invention is to provide a radius configuration of a strand guide of a continuous casting machine with a straight mold of the type described above, which would insure maintaining of maximum allowable elongation and compression values of the strand shell in all of the curved region of the strand guide, and increase of the pouring rate.

SUMMARY OF THE INVENTION

These and other objects of the present invention, which will become apparent hereinafter, are achieved by providing a radius configuration of a strand guide of a vertical bending caster including a straight mold, a vertical section adjoining the straight mold and arranged upstream of a vertically oriented bending section, and a horizontal section arranged downstream of the bending section, with the radius configuration including a bending zone adjoining the vertical section, a transition straightening zone adjoining the bending zone, a main radius guide zone adjoining the transition straightening zone, and a transition final straightening zone arranged between the main radius guide zone and the horizontal section, with the bending zone having at least one first region with a comparatively stronger bend and defined by a curvature formed by a series of continuously smaller, starting from an infinite radius of the vertical section, radii, and a second region adjoining the first region and having a comparatively smoother bend in comparison with that of the first region, and with the transition straightening zone, which forms a transition between the bending zone and the main radius guide zone being defined by a curvature with continuously increasing lengths of curvature forming radii.

The strand guide having a radius configuration according to the present invention insures, in the first region of the bending zone having a curvature the radii of which continuously decrease starting from an infinite radius of the straight section, that an inner deformation of a strand shell in following one another, bending points does not exceed a maximum allowable value of 0.25%, and that in the second region, in which the strand shell is subjected to smaller bending deformations and is in a recovery phase, the strand shell inner deformation does not exceed an allowable maximum of 0.02%

According to the present invention, a transition straightening zone with a continuously increasing lengths of the straightening zone curvature-forming radii, adjoins the bending zone. The curvature of the transition straightening zone passes into an unchanged portion of the convertible strand guide. In this transition straightening zone, the straightening process is so effected that the maximum allowable inner deformation value of 0.25% of the strand shell in the straightening points is not exceeded.

It is particular advantageous when the bending regions of the bending zone and the transition straightening zone are clothoid-shaped. It is also advantageous when the transition, final straightening zone follows advantageously the shape of a clothoid or is, as the bending regions of the bending zone and/or the transition straightening zone, a portion of a clothoid.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drapings.

BRIEF DESCRIPTION OF THE DRAWINGS

Single FIGURE of the drawings shows a schematic view of a radius configuration of a strand guide of a vertically bending caster according to the present invention.

DETAILED DESCRIPTION OF THE PREFERRED EMBODIMENTS

Figure 1:
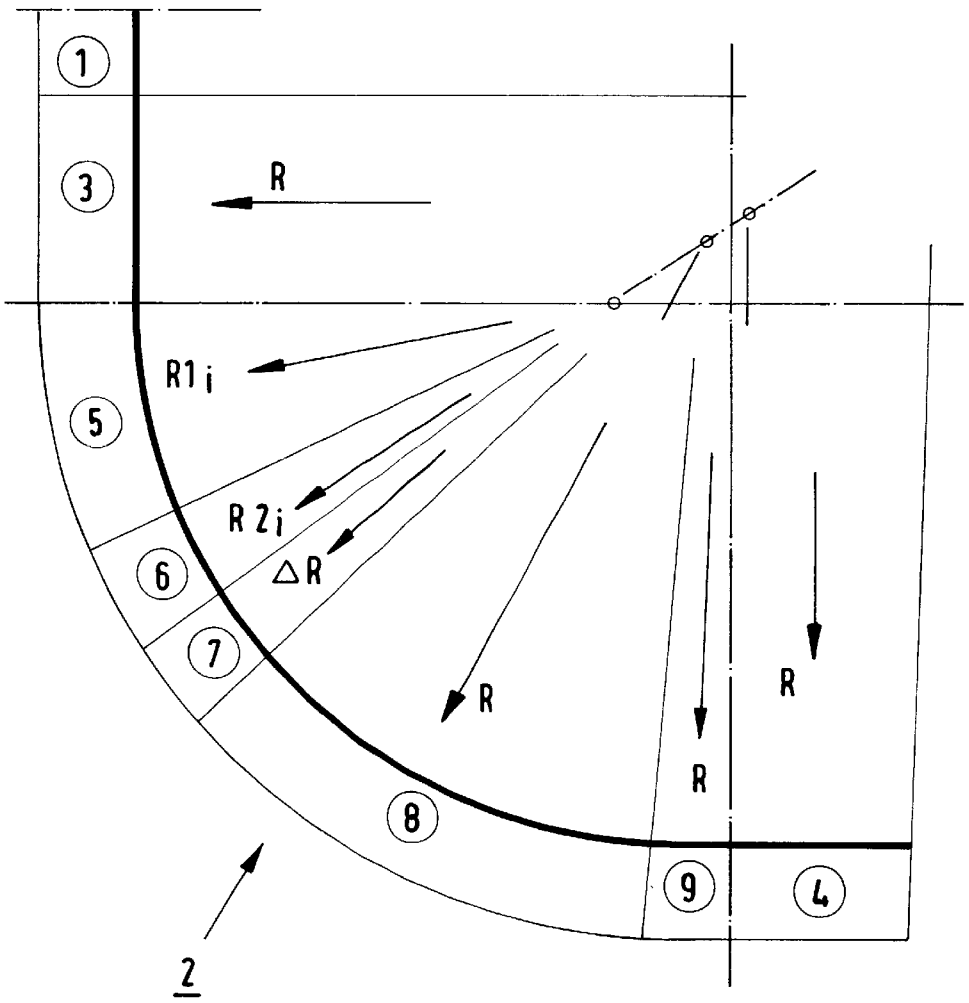

A vertical bending caster according to the present invention includes a straight mold 1 having a vertical section 3, which is located upstream of a vertically oriented bending section 2 that forms a strand guide, and a horizontal section 4 located downstream of the vertically oriented bending section 2. The bending section 2 includes a bending zone 5, 6, a transition straightening zone 7, a main radius guide zone 8, and a transition, final straightening zone 9. The bending zone 5, 6 has a first region 5, which has a comparatively stronger bend while the second region 6 which adjoins the first region 5 has a comparatively smoother bend. The vertical section 3 has an infinite radius. The curvature, which forms the first region 5, is formed by a series of continuously smaller, starting from the infinite radius, radii $R1_i$, and the curvature, which forms the second region 6, has a comparatively smaller, in comparison with the radii $R1_i$, radius $R2_i$. As can clearly be seen in the drawing, the clothoid is formed with a smooth transition from a straight vertical section 3 to the curvature, which forms the first region 5 and has a continuously increasing curve, and from the curvature, which forms the first region 5, to the curvature forming the second region 6. To provide for a tangential transition from the curvature, which forms the second.

In the second region 6 of the bending zone with a smoother curvature, the strand shell is subjected, in the regeneration phase, only to comparatively small bending deformations, with the strand shell inner deformation not exceeding 0.02%.

The transition straightening zone 7, which forms a transition between the second region 6 of the bending zone and the main radius guide zone 8, has a continuous curve with ever increasing radii )R, with the maximum allowable inner deformation value of the strand shell of 0.25% not being exceeded in the straightening points of the guide zone 8.

The radius configuration of the strand guide according to the present invention minimizes the tensile stress of the strand shell.

According to the inventive radius configuration, the bending portion, which forms the transition, final straightening zone 9, is formed with radii the length of which continuously increases up to Rinfinite. The continuously increased radii provide for a continuous bending up of the final straightening zone-forming, bending section, insuring its smooth transition into the horizontal section 4.

An essential characteristic of the radius configuration according to the present invention consists in that the main radius guide zone 8, which forms a main part of the vertically oriented bending section 2, consists of a partially shortened, but otherwise not changed, with respect to its design and bending radii, portion of the strand guide of the converted circular arc caster.

The drawing figure clearly shows that the vertically oriented bending section 2 is formed as a composite curve consisting of different clothoids having different length and forming the bending regions 5, 6, the transition zone 7, and the transition final straightening zone 9, and a circular curve which forms the main radius guide zone 8 that corresponds to a main radius guide zone of the strand guide of a circular arc caster.

The present invention not only minimizes the conversion costs but also reduces the required conversion time during which the caster remains inoperative.

The using, according to the present invention, a partially shortened, but otherwise unchanged with respect to its design and bending radii, portion of the converted circular arc caster not only permits to save material and labor costs, but also significantly shortens the conversion time which, in turn, reduces the costs associated with idle time of the caster and, hereby, the effectiveness of the conversion.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A radius configuration of a strand guide of a vertical bending caster including a straight mold, a vertical section adjoining the straight mold, and a horizontal section spaced from the vertical section, the radius configuration of the strand guide comprising:

a bending zone adjoining the vertical section;

a transition straightening zone adjoining the bending zone;

a main radius guide zone adjoining the transition straightening zone; and a transition final straightening zone arranged between the main radius guide zone and the horizontal section, wherein the bending zone has at least one first region with a comparatively stronger bend and defined by a curvature formed by a series of continuously smaller, starting from an infinite radius of the vertical section, radii, and a second region adjoining the first region and having a comparatively smoother bend in comparison with that of the first region, wherein the transition straightening zone, which forms a transition between the bending zone and the main radius guide zone, is defined by a curvature with continuously increasing lengths of curvature-forming radii, and wherein the first and second regions of the bending zone and the transition straightening zone have each a clothoidal shape.

2. A radius configuration as set forth in claim 1 wherein the first region of the bending zone is formed so that an inner deformation of a strand shell in following one another, bending points in the first region with continuously smaller radii does not exceed a maximum allowable value of 0.25% of a predetermined shape.

3. A radius configuration as set forth in claim 1, wherein the second region of the bending zone is formed so that a strand shell inner deformation does not exceed an allowable maximum of 0.02% of a predetermined shape.

4. A radius configuration as set forth in claim 1, wherein the transition straightening zone is formed so that in straightening points of the transition straightening zone, a maximum allowable strand shell inner deformation value of 0.25% of a predetermined shape is not exceeded.

5. A radius configuration as set forth in claim 1, wherein the transition, final straightening zone is formed as a curvature with radii continuously increasing from a radius of the main radius guide zone to an infinite radius, with the curvature passing into the horizontal section without transition.

6. A radius configuration as set forth in claim 5, wherein the transition, final straightening zone has a clothoidal shape.

7. A radius configuration as set forth in claim 1, wherein the bending regions of the bending zone, the transition straightening zone, and the transition final straightening zone are formed as part lengths of a clothoid.

8. A radius configuration as set forth in claim 7, wherein the bending regions of the bending zone, the transition straightening zone, and the transition, final straightening zone, together with the main radius guide zone, form a composite curve defining a vertically oriented bending section extending between the vertical and horizontal sections.

9. A radius configuration as set forth in claim 8, wherein the main radius guide section consists of a partially shortened but otherwise unchanged, with respect to design and bending radii, portion of a strand guide of a circular arc caster.

10. A strand guide for a vertical bending caster including a mold, comprising a vertical section adjoining the mold; a horizontal section spaced from the vertical section; and a vertically oriented bending section extending between the vertical and a horizontal sections and formed as composite curve consisting of different part lengths of different clothoids and a circular arc.

* * * * *